US007528736B2

(12) United States Patent
Hall et al.

(10) Patent No.: US 7,528,736 B2
(45) **Date of Patent: *May 5, 2009**

(54) LOADED TRANSDUCER FOR DOWNHOLE DRILLING COMPONENTS

(75) Inventors: David R. Hall, Provo, UT (US); Joe Fox, Spanish Fork, UT (US); Jeffery E. Daly, Cypress, TX (US)

(73) Assignee: IntelliServ International Holding (KY)

( * ) Notice: Subject to any disclaimer, the term of this patent is extended or adjusted under 35 U.S.C. 154(b) by 705 days.

This patent is subject to a terminal disclaimer.

(21) Appl. No.: 11/162,103

(22) Filed: Aug. 29, 2005

(65) Prior Publication Data

US 2005/0279508 A1 Dec. 22, 2005

Related U.S. Application Data

(60) Continuation-in-part of application No. 10/908,249, filed on May 4, 2005, now Pat. No. 7,002,445, which is a division of application No. 10/430,734, filed on May 6, 2003, now Pat. No. 6,913,093, said application No. 11/162,103 is a continuation-in-part of application No. 10/612,255, filed on Jul. 2, 2003, now abandoned, which is a continuation-in-part of application No. 10/453,076, filed on Jun. 3, 2003, now Pat. No. 7,053,788.

(51) Int. Cl.
*G01V 3/10* (2006.01)

(52) U.S. Cl. ..... 340/854.9; 340/855.1; 340/854.8; 166/65.1

(58) Field of Classification Search ..... 439/190–192; 175/320, 57; 166/65.1, 242.6; 340/854.9, 340/855.1, 854.8

See application file for complete search history.

(56) References Cited

U.S. PATENT DOCUMENTS

| | | | |
|---|---|---|---|
| 2,414,719 | A | 1/1947 | Cloud |
| 3,518,608 | A | 6/1970 | Papadopoulos |
| 4,739,325 | A | 4/1988 | MacLeod |
| 4,788,544 | A | 11/1988 | Howard |
| 6,012,015 | A | 1/2000 | Tubel |
| 6,252,518 | B1 | 6/2001 | Laborde |

(Continued)

OTHER PUBLICATIONS

PCT/US03/16475, Published Dec. 4, 2003, Applicant Baker Hughes; International Search Report "Documents Considered to Be Relevant".

*Primary Examiner*—Brian A Zimmerman
*Assistant Examiner*—Hung Q Dang
(74) *Attorney, Agent, or Firm*—Victor Segura; Jeffery E. Daly

(57) ABSTRACT

A system for transmitting information between downhole components has a first downhole component with a first mating surface and a second downhole component having a second mating surface configured to substantially mate with the first mating surface. The system also has a first transmission element with a first communicating surface and is mounted within a recess in the first mating surface. The first transmission element also has an angled surface. The recess has a side with multiple slopes for interacting with the angled surface, each slope exerting a different spring force on the first transmission element. A second transmission element has a second communicating surface mounted proximate the second mating surface and adapted to communicate with the first communicating surface.

19 Claims, 8 Drawing Sheets

U.S. PATENT DOCUMENTS 6,392,317 B1 5/2002 Hall et al.
6,670,880 B1 12/2003 Hall et al.
6,688,396 B2 2/2004 Floerke et al.
6,717,501 B2 4/2004 Hall et al.
6,799,632 B2 10/2004 Hall et al.
6,821,147 B1 11/2004 Hall et al.
6,830,467 B2 12/2004 Hall et al.
6,844,498 B2 1/2005 Hall et al.
6,866,306 B2 3/2005 Boyle et al.
6,888,473 B1 5/2005 Hall et al.
6,913,093 B2 * 7/2005 Hall et al. ..... 175/57
6,929,493 B2 8/2005 Hall et al.
6,945,802 B2 9/2005 Hall et al.
6,968,611 B2 11/2005 Hall et al.
2004/0039466 A1 2/2004 Lilly et al.
2004/0104797 A1 6/2004 Hall et al.
2004/0113808 A1 6/2004 Hall et al.
2004/0145492 A1 7/2004 Hall et al.
2004/0150532 A1 8/2004 Hall et al.
2004/0164833 A1 8/2004 Hall et al.
2004/0164838 A1 8/2004 Hall et al.
2004/0216847 A1 11/2004 Hall et al.
2004/0244916 A1 12/2004 Hall et al.
2004/0244964 A1 12/2004 Hall et al.
2004/0246142 A1 12/2004 Hall et al.
2005/0001735 A1 1/2005 Hall et al.
2005/0001736 A1 1/2005 Hall et al.
2005/0001738 A1 1/2005 Hall et al.
2005/0035874 A1 2/2005 Hall et al.
2005/0035875 A1 2/2005 Hall et al.
2005/0035876 A1 2/2005 Hall et al.
2005/0036507 A1 2/2005 Hall et al.
2005/0039912 A1 2/2005 Hall et al.
2005/0045339 A1 3/2005 Hall et al.
2005/0046586 A1 3/2005 Hall et al.
2005/0046590 A1 3/2005 Hall et al.
2005/0067159 A1 3/2005 Hall et al.
2005/0070144 A1 3/2005 Hall et al.
2005/0082092 A1 4/2005 Hall et al.
2005/0092499 A1 5/2005 Hall et al.
2005/0093296 A1 5/2005 Hall et al.
2005/0095827 A1 5/2005 Hall et al.
2005/0115717 A1 6/2005 Hall et al.
2005/0145406 A1 7/2005 Hall et al.
2005/0150653 A1 7/2005 Hall et al.
2005/0161215 A1 7/2005 Hall et al.
2005/0173128 A1 8/2005 Hall et al.
2005/0212530 A1 9/2005 Hall et al.
2005/0236160 A1 10/2005 Hall et al.
2005/0279508 A1 12/2005 Hall et al.
2005/0284659 A1 12/2005 Hall et al.
2005/0284662 A1 12/2005 Hall et al.
2005/0284663 A1 12/2005 Hall et al.
2005/0285645 A1 12/2005 Hall et al.
2005/0285705 A1 12/2005 Hall et al.
2005/0285706 A1 12/2005 Hall et al.
2005/0285751 A1 12/2005 Hall et al.
2005/0285752 A1 12/2005 Hall et al.
2005/0285754 A1 12/2005 Hall et al.

* cited by examiner

LOADED TRANSDUCER FOR DOWNHOLE DRILLING COMPONENTS

CROSS REFERENCE TO RELATED APPLICATIONS

The present application is a Continuation-in-Part of U.S. patent application Ser. No. 10/908,249 filed on May 4, 2005, which is herein incorporated by reference for all that it contains. U.S. patent application Ser. No. 10/908,249 is a divisional of U.S. patent application Ser. No. 10/430,734, now U.S. Pat. No. 6,913,093, the entire disclosure of which is hereby incorporated by reference for all it contains. Further the present application is also related to U.S. patent application Ser. No. 10/612,255 filed on Jul. 2, 2003; now U.S. Patent Publication No. 20050001738, which is a Continuation-in-Part of U.S. patent application Ser. No. 10/453,076 filed on Jun. 3, 2003; now U.S. Patent Publication No. 20040246142, both of which are herein incorporated by reference for all that they contain.

FEDERAL SPONSORSHIP

This invention was made with government support under Contract No. DE-FC26-01NT41229 awarded by the U.S. Department of Energy. The government has certain rights in the invention.

BACKGROUND OF THE INVENTION

This invention relates to oil and gas drilling, and more particularly to apparatus and methods for reliably transmitting information between downhole drilling components.

For the past several decades, engineers have worked to develop apparatus and methods to effectively transmit information from components located downhole on oil and gas drilling strings to the ground's surface. Part of the difficulty of this problem lies in the development of reliable apparatus and methods for transmitting information from one drill string component to another, such as between sections of drill pipe. The goal is to provide reliable information transmission between downhole components stretching thousands of feet beneath the earth's surface, while withstanding hostile wear and tear of subterranean conditions.

In an effort to provide solutions to this problem, engineers have developed a technology known as mud pulse telemetry. Rather than using electrical connections, mud pulse telemetry transmits information in the form of pressure pulses through fluids circulating through a well bore. However, data rates of mud pulse telemetry are very slow compared to data bandwidths needed to provide real-time data from downhole components.

For example, mud pulse telemetry systems often operate at data rates less than 10 bits per second. At this rate, data resolution is so poor that a driller is unable to make crucial decisions in real time. Since drilling equipment is often rented and very expensive, even slight mistakes incur substantial expense. Part of the expense can be attributed to time-consuming operations that are required to retrieve downhole data or to verify low-resolution data transmitted to the surface by mud pulse telemetry. Often, drilling or other procedures are halted while crucial data is gathered.

In an effort to overcome limitations imposed by mud pulse telemetry systems, reliable connections are needed to transmit information between components in a drill string. For example, since direct electrical connections between drill string components may be impractical and unreliable, converting electrical signals to magnetic fields for later conversion back to electrical signals offers one solution for transmitting information between drill string components.

Nevertheless, various factors or problems may make data transmission unreliable. For example, dirt, rocks, mud, fluids, or other substances present when drilling may interfere with signals transmitted between components in a drill string. In other instances, gaps present between mating surfaces of drill string components may adversely affect the transmission of data therebetween.

Moreover, the harsh working environment of drill string components may cause damage to data transmission elements. Furthermore, since many drill string components are located beneath the surface of the ground, replacing or servicing data transmission components may be costly, impractical, or impossible. Thus, robust and environmentally-hardened data transmission components are needed to transmit information between drill string components.

BRIEF SUMMARY OF THE INVENTION

In view of the foregoing, it is a primary object of the present invention to provide robust transmission elements for transmitting information between downhole tools, such as sections of drill pipe, in the presence of hostile environmental conditions, such as heat, dirt, rocks, mud, fluids, lubricants, and the like. It is a further object of the invention to maintain reliable connectivity between transmission elements to provide an uninterrupted flow of information between drill string components.

Consistent with the foregoing objects, and in accordance with the invention as embodied and broadly described herein, an apparatus is disclosed in one embodiment of the present invention as including a transmission element having a communicating surface mountable proximate a mating surface of a downhole drilling component, such as a section of drill pipe.

By "mating surface," it is meant a surface on a downhole component intended to contact or nearly contact the surface of another downhole component, such as another section of drill pipe. For example, a mating surface may include threaded regions of a box end or pin end of drill pipe, primary or secondary shoulders designed to come into contact with one another, or other surfaces of downhole components that are intended to contact or come into close proximity to surfaces of other downhole components.

A transmission element may be configured to communicate with a corresponding transmission element located on another downhole component. The corresponding transmission element may likewise be mountable proximate a mating surface of the corresponding downhole component. In order to close gaps present between communicating surfaces of transmission elements, transmission elements may be biased with respect to the mating surfaces they are mounted on.

By "biased," it is meant, for the purposes of this specification, that a transmission element is urged, by a biasing member, such as a spring or an elastomeric material, or by a "spring force" caused by contact between a transmission element and a mating surface, in a direction substantially orthogonal to the mating surface. Thus, the term "biased" is not intended to denote a physical position of a transmission element with respect to a mating surface, but rather the condition of a transmission element being urged in a selected direction with respect to the mating surface. In selected embodiments, the transmission element may be positioned flush with, above, or below the mating surface.

Since a transmission element is intended to communicate with another transmission element mounted to another downhole component, in selected embodiments, only a single transmission element is biased with respect to a mating surface. For example, transmission elements may be biased only in "pin ends" of downhole components, but may be unbiased or fixed in "box ends" of the same downhole tools or vice versa. However, in other embodiments, the transmission elements are biased in both the pin ends and box ends.

In selected embodiments, a gap may be present between mating surfaces of downhole components due to variations in tolerances, or materials that may become interposed between the mating surfaces. In other embodiments, the mating surfaces are in contact with one another. In selected embodiments, a biasing member, such as a spring or elastomeric material may be inserted between a transmission element and a corresponding mating surface to effect a bias therebetween.

A mating surface may be shaped to include a recess. A transmission element may be mounted or housed within the recess. In selected embodiments, a recess may include a locking mechanism to retain the transmission element within the recess. In a preferred embodiment, the locking mechanism is a locking shoulder formed in the recess. A transmission element, once inserted into the recess, may slip past and be retained by the locking shoulder.

A transmission element and corresponding recess may have an annular shape. In selected embodiments, a transmission element may snap into the recess and be retained by the locking mechanism. In selected embodiments, angled surfaces of the recess and the transmission element may create a "spring force" urging the transmission element in a direction substantially orthogonal to the mating surface. This "spring force" may be caused by the contact of various surfaces of the transmission element and the recess, including the outside diameters, the inside diameters, or a combination thereof.

In selected embodiments, a transmission element on a downhole component communicates with a transmission element on a separate downhole component by converting an electrical signal to a magnetic field or current. The magnetic field or current induces an electrical current in a corresponding transmission element, thereby recreating the original electrical signal. In other embodiments, a transmission element located on a downhole component may communicate with a transmission element on another downhole component due to direct electrical contact therebetween.

In another aspect of the present invention, a method for transmitting information between downhole components located on a downhole tool string includes mounting a transmission element, having a communicating surface, proximate a mating surface of a downhole component. Another transmission element, having a communicating surface, may be mounted proximate a mating surface of another downhole component, the mating surfaces of each downhole component being configured to contact one another. The method may further include biasing at least one transmission element with respect to a corresponding mating surface to close gaps present between communicating surfaces of the transmission elements.

BRIEF DESCRIPTION OF THE DRAWINGS

The foregoing and other features of the present invention will become more fully apparent from the following description, taken in conjunction with the accompanying drawings. Understanding that these drawings depict only typical embodiments in accordance with the invention and are, therefore, not to be considered limiting of its scope, the invention will be described with additional specificity and detail through use of the accompanying drawings.

DETAILED DESCRIPTION OF THE INVENTION AND THE PREFERRED EMBODIMENT

Figure 1:
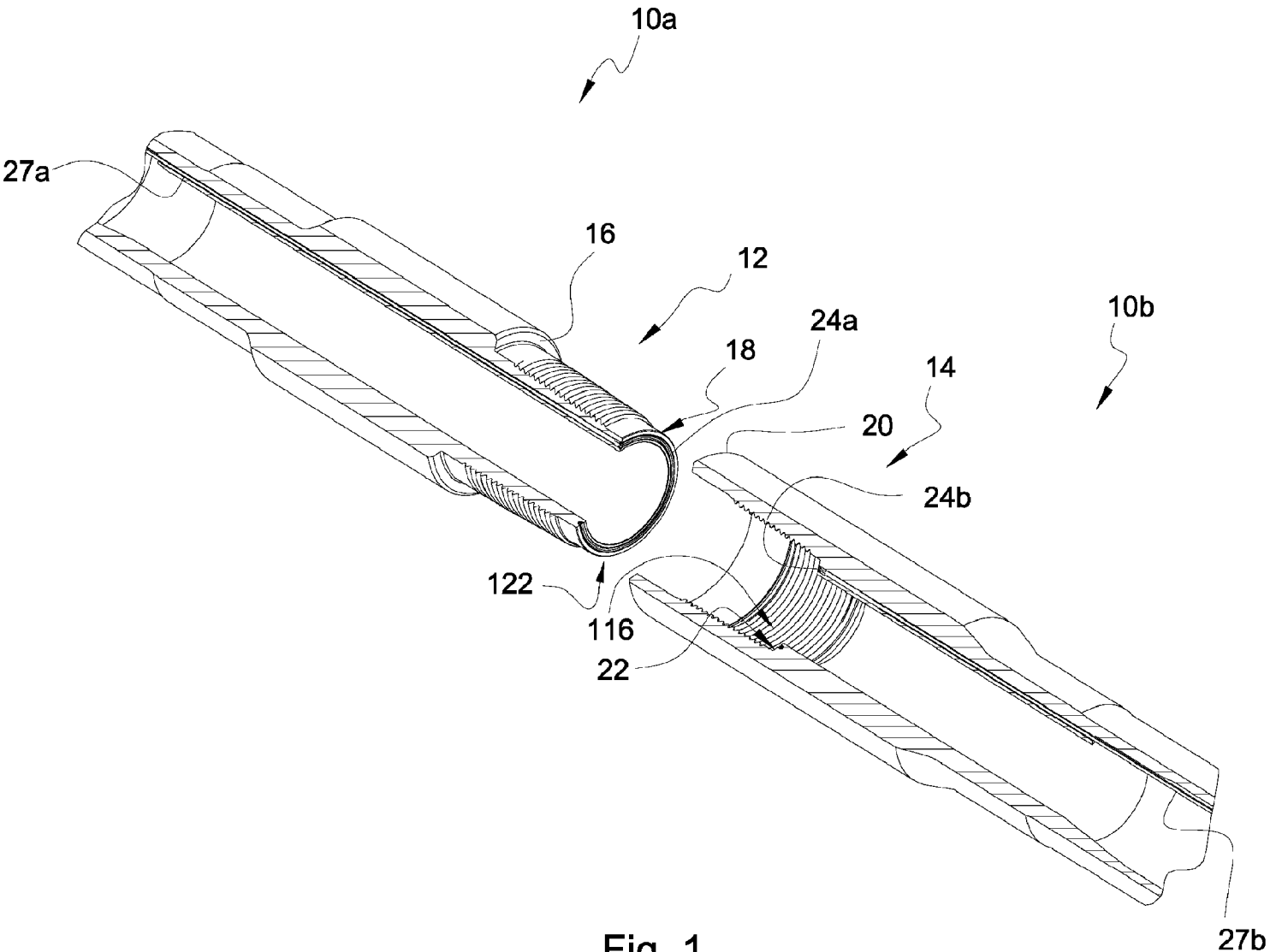
FIG. 1 is a perspective view illustrating one embodiment of sections of downhole drilling pipe using transmission elements, in accordance with the invention, to transmit and receive information along a drill string.

It will be readily understood that the components of the present invention, as generally described and illustrated in the Figures herein, could be arranged and designed in a wide variety of different configurations. Thus, the following more detailed description of embodiments of apparatus and methods of the present invention, as represented in the Figures, is not intended to limit the scope of the invention, as claimed, but is merely representative of various selected embodiments of the invention.

It should also be noted that the reference numerals of the figures, when referring to specific examples, may be accompanied by a lower case letter for clarity, but when they are generically referenced in the specification they will not be necessarily be accompanied by a lower case letter. It would be apparent to one of ordinary skill in the art to apply the details described in the examples generally or vice versa.

Referring to FIG. 1, downhole components 10*a*, 10*b*, may be drill pipes or other downhole tools. Preferably the downhole components 10*a*, 10*b* are drill pipe, each with a pin end 12 and a box end 14. In certain embodiments, a pin end 12 may include an external threaded portion to engage an internal threaded portion of the box end 14. When threading a pin end 12 into a corresponding box end 14, various shoulders may engage one another to provide structural support to components connected in a downhole tool string.

The shoulders may provide first and second mating surface 116, 122. For example, the mating surfaces may include a primary shoulder 16 and a secondary shoulder 18 on the pin end 12. Likewise, the box end 14 may include a corresponding primary shoulder 20 and secondary shoulder 22 as mating surfaces. A primary shoulder 16, 20 may be labeled as such to indicate that a primary shoulder 16, 20 provides the majority of the structural support to a downhole component 10. Nevertheless, a secondary shoulder 18 in the pin end 12 may also engage a corresponding secondary shoulder 22 in the box end 14, providing additional support or strength to components 10 connected in series.

As was previously discussed, apparatus and methods are needed to transmit information along a string of connected downhole components 10. One major issue is the transmission of information across joints where a pin end 12 connects to a box end 14. In selected embodiments, a transmission element 24*b* may be mounted proximate a first mating surface 116, such as a secondary shoulder 22 of the box end 14, to communicate information to another transmission element 24*a* located on a second mating surface 122, such as a secondary shoulder 18 on a pin end 12. Cables 27*a*, 27*b*, or other transmission medium 27, may be operably connected to the transmission elements 24*a*, 24*b* to transmit information therefrom along the components 10*a*, 10*b*.

In certain embodiments, a recess may be provided in the first and second mating surfaces 116, 122 to house transmission elements 24*b*, 24*a*. The transmission elements 24*a*, 24*b* may have an annular shape and be mounted around the radius of the downhole component 10. Since the first mating surface 116 may contact or come very close to the second mating surface 122 of a pin end 12, a transmission element 24*b* may sit substantially flush with the first mating surface 116 on a box end 14. Likewise, a transmission element 24*a* may sit substantially flush with the second mating surface 122 of a pin end 12.

In selected embodiments, a transmission element 24*a* may communicate with a corresponding transmission element 24*b* by direct electrical contact therewith. In other embodiments, the transmission element 24*a* may convert an electrical signal to a magnetic flux or magnetic current. A corresponding transmission element 24*b*, located proximate the transmission element 24*a*, may detect the magnetic field or current. The magnetic field may induce an electrical current into the transmission element 24*b* that may then be transmitted from the transmission element 24*b* to the electrical cable 27*b* located along the downhole component 10*b*. In other selected embodiments the transmission elements may be selected from the group consisting of optical couplers, radio wave guide couplers, or acoustic couplers.

As was previously stated, a downhole drilling environment may adversely affect communication between transmission elements 24*a*, 24*b* located on successive downhole components 10. For example, materials such as dirt, mud, rocks, lubricants, or other fluids, may inadvertently interfere with the contact or communication between transmission elements 24*a*, 24*b*. In other embodiments, gaps present between a first mating surface 116 and a second mating surface 122 due to variations in component tolerances may interfere with communication between transmission elements 24*a*, 24*b*.

Figure 2:
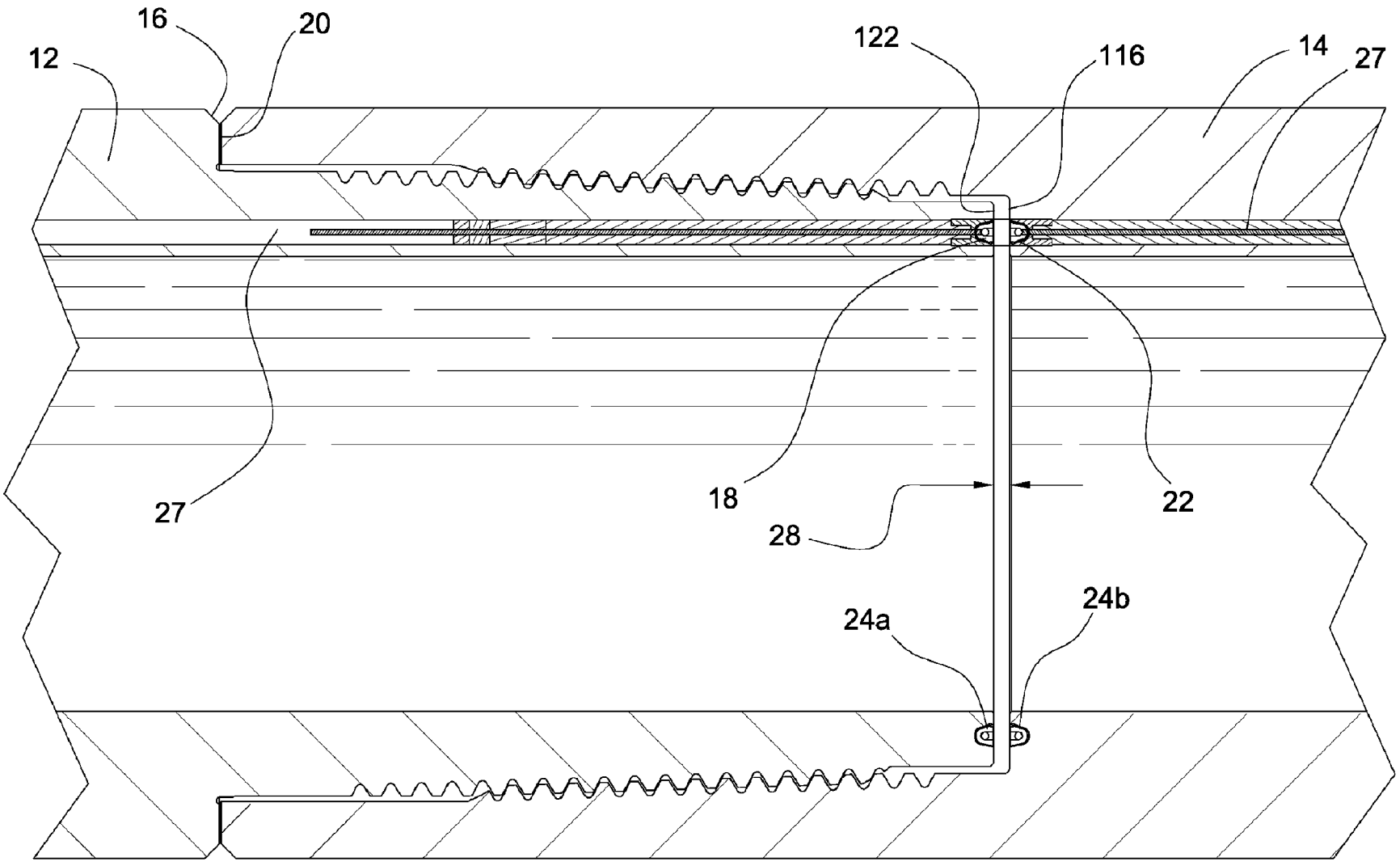
FIG. 2 is a cross-sectional view illustrating one embodiment of gaps that may be present between a pin end and box end of downhole drilling components, thereby causing unreliable communication between transmission elements.

Referring to FIG. 2, a gap 28 may be present between the first and second surfaces 116, 122. This gap 28 may be the result of variations in manufacturing tolerances between different sections 10*a*, 10*b* of pipe. In other embodiments, the gap 28 may be the result of materials such as dirt, rocks, mud, lubricants, fluids, or the like, interposed between the mating surfaces 116, 122.

If transmission elements 24*a*, 24*b* are designed for optimal function when in direct contact with one another, or when in close proximity to one another, materials or variations in tolerances leaving a gap 28 may cause malfunction of the transmission elements 24*a*, 24*b*, impeding or interfering with the flow of data. In accordance with the present invention, a transmission element 24*a*, 24*b* may be provided such that it is moveable with respect to a corresponding mating surface 122, 116. Thus, transmission elements 24*a*, 24*b* may be translated such that they are in closer proximity to one another to enable effective communication therebetween. In selected embodiments, direct contact between transmission elements 24*a*, 24*b* may be required.

In other embodiments, a specified separation may be allowed between transmission elements 24*a*, 24*b* for effective communication. As illustrated, transmission elements 24*a*, 24*b* may be mounted in secondary shoulders 18, 22 of the pin end 12 and box end 14 respectively. In reality, the transmission elements 24*a*, 24*b* may be provided in any suitable mating surface of the pin end 12 and box end 14, such as in primary shoulders 16, 20.

Figure 3:
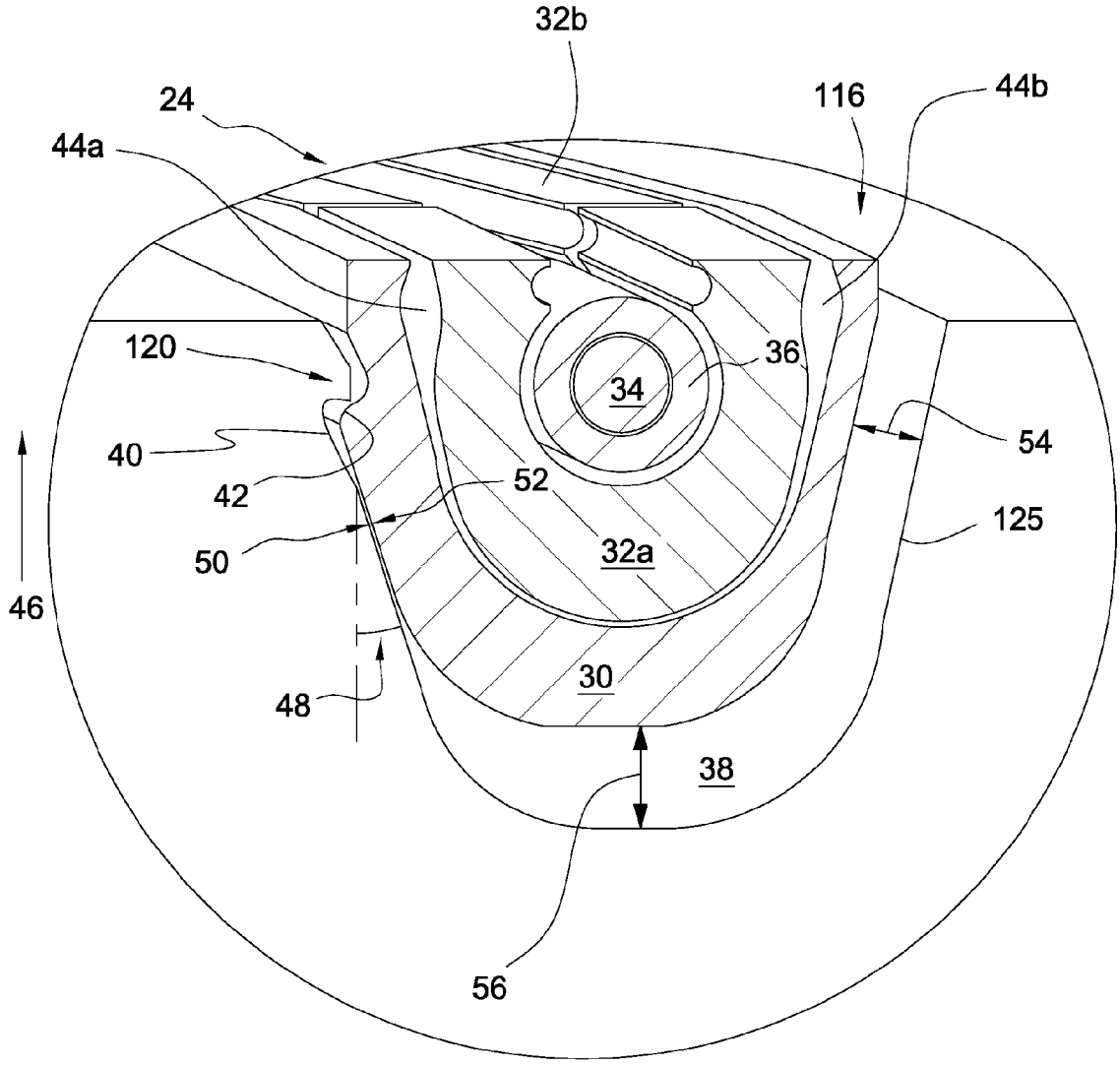
FIG. 3 is a perspective cross-sectional view illustrating one a prior art embodiment of an improved transmission element retained within a recess of a box end or pin end of a downhole drilling component.

Referring to FIG. 3, in selected embodiments, a transmission element 24 may include an annular housing 30. The annular housing 30 may include a magnetically conducting electrically insulating element 32 therein, such as ferrite or some other material of similar electrical and magnetic properties. The element 32*a* may be formed in a U-shape and fit within the housing 30. Within the U-shaped element 32*a*, a conductor 34 may be provided to carry electrical current therethrough. In selected embodiments, the electrical conductor 34 is coated with an electrically insulating material 36.

As current flows through the conductor 34, a magnetic flux or field may be created around the conductor 34. The U-shaped element 32 may serve to contain the magnetic flux created by the conductor 34 and prevent energy leakage into surrounding materials. The U-shape of the element 32 may also serve to transfer magnetic current to a similarly shaped element 32 in another transmission element 24. Since materials such as ferrite may be quite brittle, the U-shaped elements 32 may be provided in segments 32*a*, 32*b* to prevent cracking or breakage that might otherwise occur using a single piece of ferrite.

As was previously stated, a recess 38 may be provided in the first mating surface 116. Likewise, the transmission element 24 may be inserted into and retained within the recess 38. In selected embodiments, the recess 38 may include a locking mechanism 120 to enable the housing 30 to enter the recess 38 while preventing the exit therefrom. For example, in one embodiment, a locking mechanism 120 may simply be a groove 40 formed within the larger recess 38. A corresponding shoulder 42 may be formed in the housing 30 such that the shoulder 42 engages the recess 40, thereby preventing the housing 30 from exiting the larger recess 38.

As was previously discussed, in order to close gaps 28 (as shown in FIG. 2) present between transmission elements 24*a*, 24*b*, in the pin end 12 and box end 14, respectively, a transmission element 24 may be biased with respect to the first mating surface 116. That is, a transmission element 24 may be urged in a direction 46 with respect to the first mating surface 116. In selected embodiments, angled surfaces 50, 52 of the recess 38 and housing 30, respectively, may provide this "spring force" in the direction 46.

For example, each of the angled surfaces 50, 52 may form an angle 48 with respect to a direction normal or perpendicular to the surface 18. This angle 48 may urge the housing 30 in a direction 46 due to its slope 48. That is, if the housing 30 is in tension as it is pressed into the recess 38, a spring-like force may urge the housing 30 in a direction 46.

In selected embodiments, the housing 30 may only contact a single surface 50 of the recess 38. Gaps 54, 56 may be present between the recess 38 and the housing 30 along other surfaces. These may serve several purposes.

For example, if the housing 30 were to contact both a surface 50 on one side of the recess 38, as well as another surface 125 on the other side of the recess 38, pressure on both sides of the housing 30 may create undesired stress on a U-shaped element 32 or elements 32*a*, 32*b*. If an element 32 is constructed of ferrite, the stress may cause cracking or damage due to its brittleness. Thus, in selected embodiments, it may be desirable that only a single surface 50 of the housing 30 contact a surface 52 of the recess 38. In other embodiments of the invention, the angle 48 may be formed in the other surface 125 which acts to bias the transmission element 24 out of the recess 38.

Nevertheless, a surface 50 in contact with the housing 38 may be along either an inside or outside diameter of the recess 38, or a combination thereof. Spaces 44*a*, 44*b*, may be provided between the housing 30 and U-shaped elements 32. These spaces 44*a*, 44*b* may be filled with an elastomeric or bonding material to help retain the U-shaped elements 32 within the housing 30.

Figure 4:
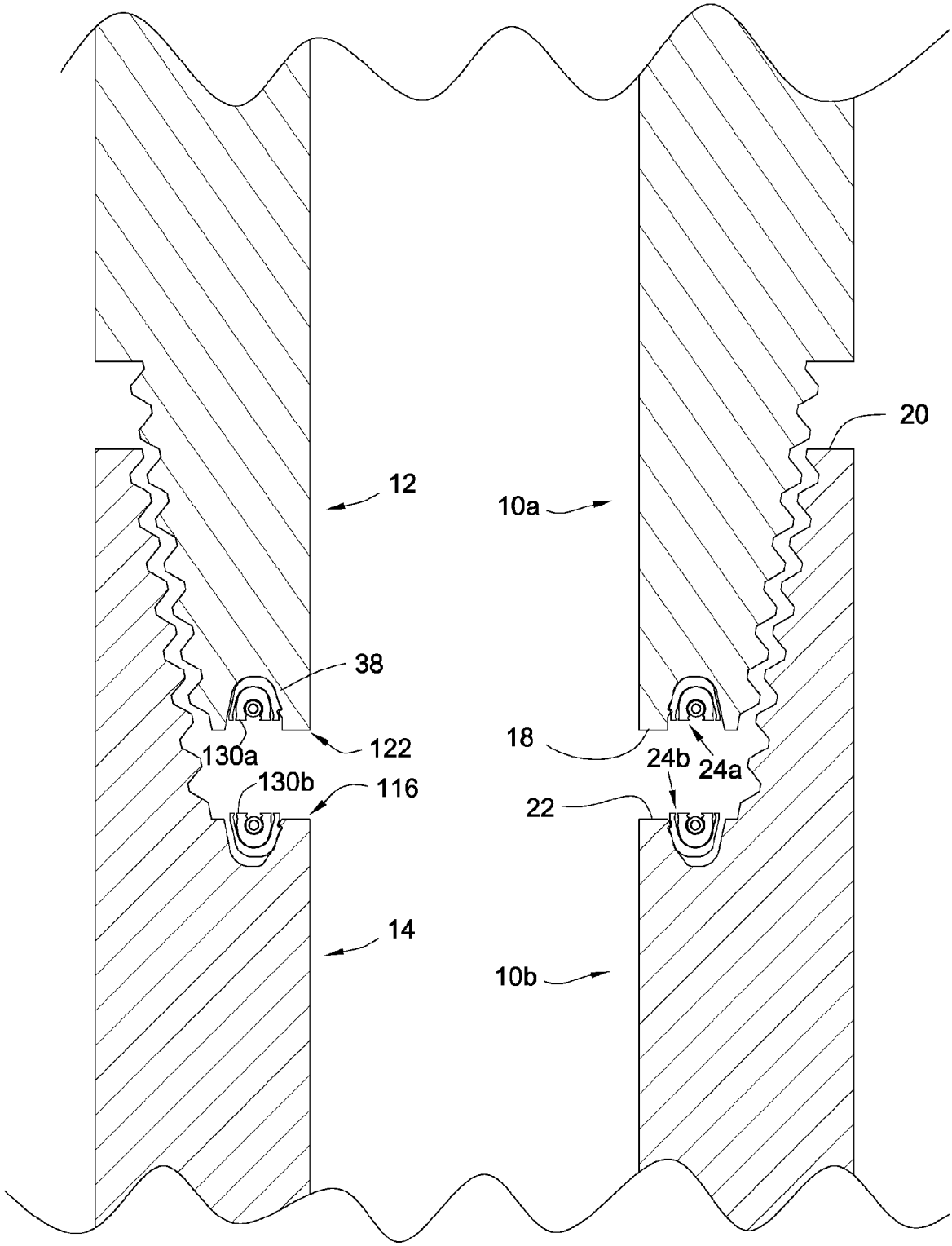
FIG. 4 is a cross sectional view illustrating one embodiment of transmission elements with respect to their mating surfaces.

FIG. 4 is a cross sectional view illustrating one embodiment of transmission elements 24*a*, 24*b* with respect to their mating surfaces 122, 116. It may be desirable for a communication surface 130*a* of transmission element 24*a* to be located with the recess 38 of the second mating surface 122. In embodiments where the second mating surface 122 is located in the pin end 12 of the downhole component 10, the secondary shoulder 18 may be subject to contacting various objects. For example, when the downhole components 10*a* and 10*b* are brought together to form a joint, downhole component 10*a* may be misaligned such that the secondary shoulder 18 of the pin end 12 contacts the primary shoulder 20 of downhole component 10*b*, such that transmission element 24*a* is damaged. In contrast, transmission element 24*b* located in the secondary shoulder 22 of the box end 14 may be protected from contacting various objects. It may be desirable to for the communication surface 130*b* of a transmission element 24*b* located in the secondary shoulder 22 of the box end 14 to extend beyond its mating surface 116. In this manner, the first and second communications surfaces 130*a*, 130*b* may also contact another when the mating surfaces 116, 122 are contacting one another.

Figure 5:
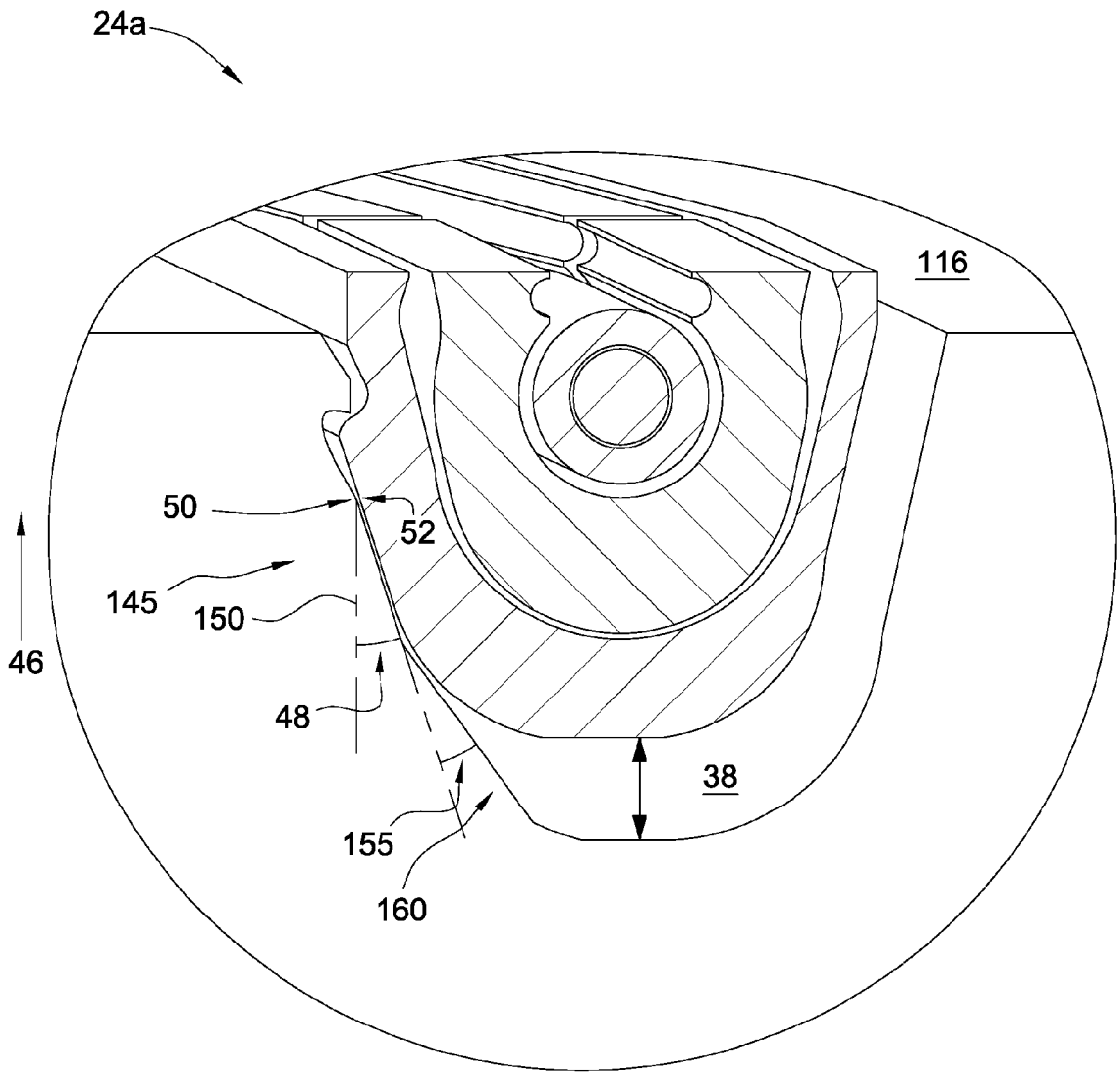
FIG. 5 is a perspective cross sectional view of a recess comprising a side with multiple slopes.

FIG. 5 is a perspective cross sectional view of a recess 38 comprising a side with multiple slopes 150, 160. The angled surface 50 of the side 145 may comprise a first slope 150 which acts to bias the transmission element 24*a* out of the recess 38. As the second mating surface 122 engages the first mating surface 116, transmission element 24*b* (shown in FIG. 4), will exert a force to push transmission element 24*a* deeper into the recess 38. Since in certain embodiments, it may be preferable to have a strong contact between the transmission elements 24*a* and 24*b*, it may be desirable for the force biasing the transmission element 24*a* in a direction 46 out of the recess 38 to increase as the force to push transmission element 24*a* back in recess 38 increases. This may be accomplished by forming a second slope 160 on the angled surface 50 to interact with the angled surface 52 of transmission element 24*a*. An angle 155 formed in the angled surface 50 of the recess 38 will generally determine how strong the increased force biasing transmission element 24*a* out of the recess 38 will be. As described in FIG. 3, the first and second slope 150, 160 may be formed in the other surface 125 of the recess 38, such that both surfaces 50 and 125 or either surface 50 or surface 125 cause the biasing force.

It may be desirable for the side of the recess 38 to comprise multiple slopes 150, 160 so that the transmission elements 24*a* and 24*b* may absorb the force of coming into contact. As the downhole components are torqued together, the transmission elements 24*a* and 24*b* come into contact with a lesser force which may reduce damage, but when the transmission elements 24*a* and 24*b* are in their final position after the downhole components are torqued there is a stronger force between transmission elements 24*a* and 24*b* which may aid in signal transmission.

Figure 6:
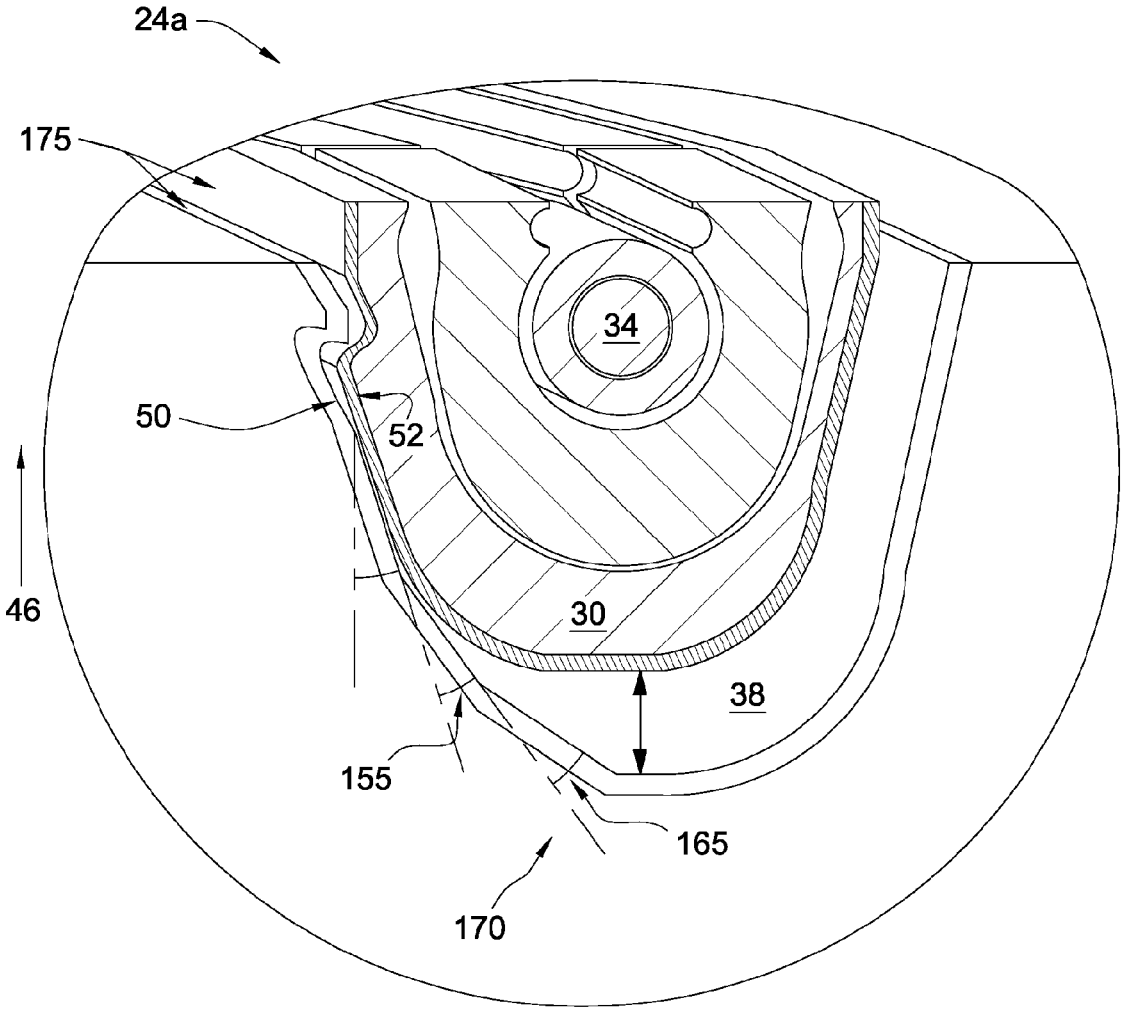
FIG. 6 is a perspective cross sectional view of another embodiment of a recess comprising multiple slopes.

FIG. 6 shows a perspective cross sectional view of an alternative embodiment of the angled surface 50. Another angle 165 formed in the angled surface 50 allows a third slope 170 to increase force 46 to resist a force pushing the transmission element 24*a* deeper into the recess 38. It would be apparent to one of ordinary skill in the art to add as many slopes and angles into angled surface 50 as may be desired. It may also be desirable to provide a protective coating 175 on the angled surface 50 of the recess 38 and on the angled surface 52 of the transmission element 24*a*. In the preferred embodiment, the coil 34 is grounded to the housing 30 of the transmission element 24*a* and an electrical contact is necessary between the angled surfaces 50, 52. A protective coating 175, then, is preferably electrically conductive and comprises a material selected from the group consisting of cobalt, nickel, tin, tin-lead, platinum, palladium, gold, silver, zinc, phosphorous, carbon, or combinations thereof. The protective coating 175 may reduce friction between the angled surfaces 50, 52 and/or the protective coating 175 may provide a corrosion resistive layer.

Figure 7:
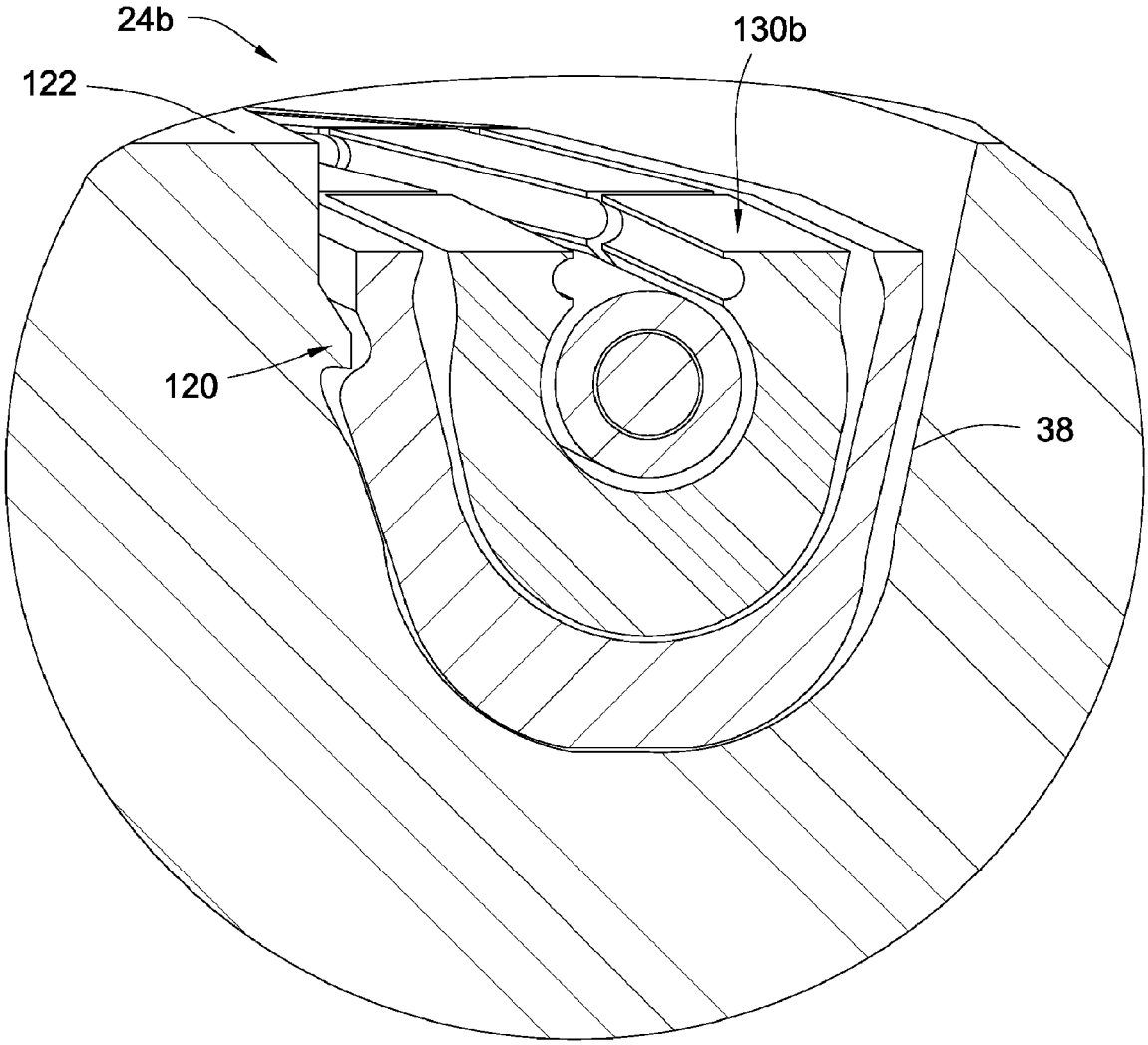
FIG. 7 is a perspective cross sectional view of a transmission element with respect to its mating surface.

FIG. 7 is a perspective cross sectional view of transmission element 24*b* with respect to its mating surface 122. In some embodiments, where transmission element 24*a* (see FIG. 5) extends beyond the mating surface 116, it may be desirable to situate the transmission element 24*b* such that its communication surface 130*b* is also located within the recess 38. This may be accomplished by providing a locking mechanism 120 deep enough to the recess 38 to prevent the communication surface 130*b* of transmission element 24*b* from extending or being flush with mating surface 122.

Figure 8:
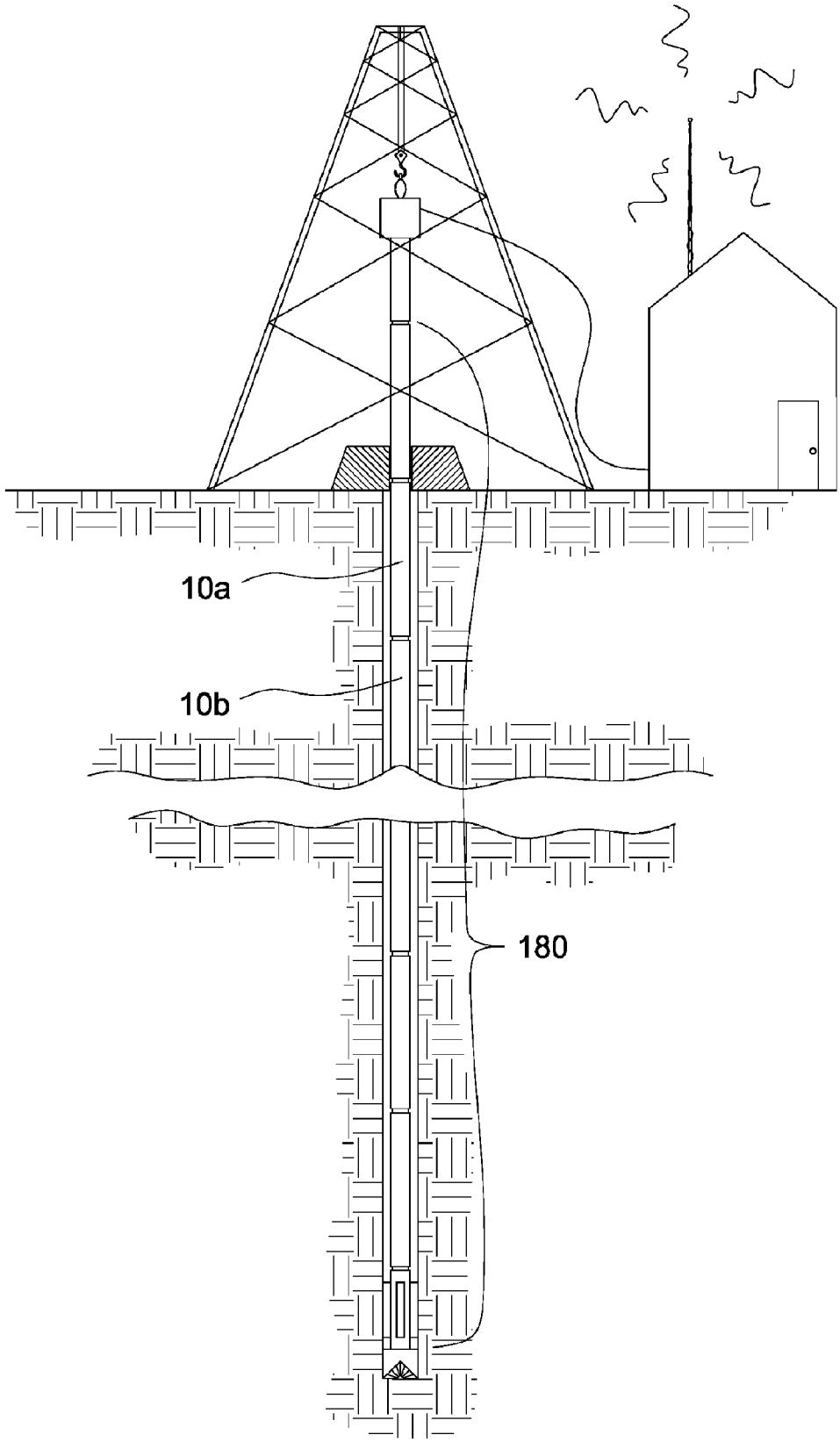
FIG. 8 is a perspective view of a downhole tool string.

FIG. 8 is a perspective view of a downhole tool string 180. Downhole components 10*a*, 10*b* as described above may be utilized in various applications. A preferred application is oil and gas exploration, but other applications may include geothermal exploration, directional drilling, such as under lakes and rivers, mining, or installing underground utilities. Preferably, the tool string 180 comprises a network having nodes, which may take measurements, repeat or amplify signals, and provide power for downhole tools. A preferred downhole network compatible with the present invention is described in U.S. Pat. No. 6,670,880 to Hall et al., which is herein incorporated for all that it discloses. Alternative transmission systems that may be compatible with the present invention include U.S. Pat. No. 6,688,396 to Floerke et al. and U.S. Pat. No. 6,641,434 to Boyle et al., both of which are herein incorporated by reference for all that they disclose.

Whereas the present invention has been described in particular relation to the drawings attached hereto, it should be understood that other and further modifications apart from those shown or suggested herein, may be made within the scope and spirit of the present invention.

What is claimed is:

1. A system for transmitting information between downhole components, comprising:

a first downhole component having a first mating surface;

a second downhole component having a second mating surface configured to substantially mate with the first mating surface;

a first transmission element having a first communicating surface and mounted within a recess in the first mating surface;

the recess comprising a side having multiple slopes for interacting with an angled surface on the first transmission element; each slope effecting a different spring force on the first transmission element; and a second transmission element having a second communicating surface mounted proximate the second shoulder and adapted to communicate with the first communicating surface.

2. The system of claim 1, further comprising a locking mechanism to retain the transmission element in the recess.

3. The system of claim 2, wherein the locking mechanism is formed in the recess.

4. The system of claim 1, wherein the recess comprises a protective coating.

5. The system of claim 1, wherein the second transmission element is biased.

6. The system of claim 1, wherein the second communications surface is located within a second recess within the second mating surface.

7. The system of claim 1, wherein the first communications element extends beyond the first mating surface.

8. The system of claim 1, wherein the first mating surface is a secondary shoulder.

9. The system of claim 1, wherein the first mating surface is located on a box end of the first downhole component.

10. The system of claim 1, wherein the transmission elements are selected from the group consisting of direct electrical couplers, inductive couplers, optical couplers, radio wave couplers, and acoustic couplers.

11. The system of claim 1, wherein the transmission elements have an annular shape.

12. The system of claim 1, wherein the angled surface comprises a protective coating.

13. The system of claim 1, wherein the first and second downhole tools are connected and the communications surfaces are proximate one another.

14. The system of claim 13, wherein the first and second communications surfaces contact one another.

15. The system of claim 1, wherein the transmission elements are in communication with a downhole network.

16. A system for transmitting information between downhole components, comprising:

a first downhole component having a first mating surface;

a second dowohole component having a second mating surface configured to substantially mate with the first mating surface;

a first transmission element having a first communicating surface and mounted within a first recess in the first mating surface;

the first transmission element having an angled surface;

the first recess comprising a side having multiple slopes for interacting with the angled surface to exert multiple spring forces on the first transmission element;

the first communication surface extending beyond the first mating surface, and;

a second transmission element disposed within the second mating surface and having a second communicating surface within the secondary mating surface.

17. The system of claim 16, wherein the first mating surface is located in the box end of the first downhole component.

18. The system of claim 17, wherein the first transmission element is retained by a first locking mechanism formed within the first recess.

19. The system of claim 17, wherein the transmission elements are selected from the group consisting of direct electrical couplers, inductive couplers, optical couplers, radio wave couplers, and acoustic couplers.

* * * * *